US007516704B2

(12) United States Patent
Snider et al.

(10) Patent No.: US 7,516,704 B2
(45) Date of Patent: Apr. 14, 2009

(54) PAINT STATION

(75) Inventors: Gregory Scott Snider, Bel Air, MD (US); Robert H. Gifford, New Freedom, PA (US); Thomas J. Wheeler, Pomona, CA (US); Alfred H. Judge, Prescott, AZ (US); Christopher J. Murray, Baltimore, MD (US); Mark Lawrence, Owings Mills, MD (US); Marcus W. Bosch, Ottawa (CA); Jason Busschaert, Towson, MD (US); Robert David Watters, Ottawa (CA); Aldo Faustino Balatti, Greely (CA); Michael Georges Sirois, Ottawa (CA); Cliff Dean Read, Carp (CA); Steven Canova, Manchester, MD (US)

(73) Assignee: Black & Decker Inc., Newark, DE (US)

( * ) Notice: Subject to any disclaimer, the term of this patent is extended or adjusted under 35 U.S.C. 154(b) by 457 days.

(21) Appl. No.: 11/034,269

(22) Filed: Jan. 12, 2005

(65) Prior Publication Data

US 2005/0150724 A1 Jul. 14, 2005

Related U.S. Application Data

(60) Provisional application No. 60/536,242, filed on Jan. 13, 2004.

(51) Int. Cl.
*A47B 3/00* (2006.01)

(52) U.S. Cl. ..... 108/25; 108/44; 312/258; 312/328; 206/209; 206/564; 248/100

(58) Field of Classification Search ..... 108/25, 108/26, 42, 43, 129, 115, 162, 176, 90, 38; 312/140.2, 140.3, 258, 262, 327, 328; 206/209, 206/564; 182/129; 248/95, 99, 100
See application file for complete search history.

(56) References Cited

U.S. PATENT DOCUMENTS

| | | | | |
|---|---|---|---|---|
| 889,741 | A | 6/1908 | Additon | |
| 963,769 | A | 7/1910 | Johnson et al. | |
| 1,133,109 | A | 3/1915 | Derbyshire | |
| 1,886,806 | A * | 11/1932 | Hanley | 108/90 |
| 2,241,309 | A | 5/1941 | Kovalik | |
| 2,363,699 | A | 11/1944 | Smith | |
| 2,550,959 | A | 5/1951 | Bowman | |

(Continued)

*Primary Examiner*—Richard E Chilcot, Jr.
*Assistant Examiner*—Matthew J. Smith
(74) *Attorney, Agent, or Firm*—Harness, Dickey & Pierce, P.L.C.

(57) ABSTRACT

A portable paint station that includes a work table and a pair of legs that are positionable in a retracted position and an extended position. In one form, the paint station provides a work surface that may be selectively positioned at two distinct heights. In another form, the paint station provides a work surface with a roller tray recess that may be selectively covered to resist the formation of a skin on paint that is located in the recess. In a further form, the paint station provides a work table with a pair of legs. At least one set of the legs has a handle aperture that may be employed to hand carry the paint station on its side. In yet another form, the paint station includes a roller tray assembly that facilitates the short-term storage of a paint roller that is loaded with paint.

14 Claims, 8 Drawing Sheets

U.S. PATENT DOCUMENTS 3,850,114 A * 11/1974 Ganteaume ..... 108/38
4,157,798 A * 6/1979 Lin ..... 108/115
4,437,411 A 3/1984 Maxwell
4,599,968 A 7/1986 Ryder et al.
4,747,352 A * 5/1988 Guidry et al. ..... 108/26
4,825,779 A 5/1989 Simms
D302,618 S 8/1989 Gottselig
4,880,248 A 11/1989 Elmer
4,901,998 A 2/1990 Griffith
4,993,726 A 2/1991 Schumacher et al.
5,002,293 A 3/1991 Gottselig
5,082,301 A 1/1992 Schumacher et al.
5,190,303 A 3/1993 Schumacher et al.
5,286,045 A 2/1994 Cyphers et al.
D345,841 S 4/1994 Bekius
5,315,935 A 5/1994 Weisenfels
5,318,171 A 6/1994 Szekely
5,370,064 A * 12/1994 Sgabellone ..... 108/162
5,460,391 A 10/1995 Gantz et al.
5,479,866 A * 1/1996 Rae ..... 108/25
5,535,682 A 7/1996 Aigeldinger
5,542,359 A * 8/1996 Polries ..... 108/26
D399,111 S 10/1998 Budesa
D400,329 S * 10/1998 Lindo ..... D32/53.1
6,164,212 A 12/2000 Haggard
6,196,410 B1 * 3/2001 Hocking ..... 206/209
6,264,026 B1 * 7/2001 Bradley ..... 206/564
6,363,865 B1 4/2002 Alcala et al.
6,607,015 B1 8/2003 Chen
6,694,893 B2 2/2004 Alcala et al.
2002/0056967 A1 5/2002 Carrillo
2002/0069792 A1 6/2002 Alcala et al.
2002/0129746 A1 9/2002 Donnelly
2002/0185799 A1 12/2002 Mizuochi et al.
2003/0102644 A1 6/2003 Figueroa

* cited by examiner

PAINT STATION

CROSS-REFERENCE TO RELATED APPLICATIONS

This application claims the benefit of U.S. Provisional Patent Application Ser. No. 60/536,242 entitled "Paint Station" and filed Jan. 13, 2004.

INTRODUCTION

The present invention generally relates to portable workbenches and more particularly to a portable, foldable workbench for use in painting.

SUMMARY

In one form, the present teachings provide a paint station with a tray, which has a sloped portion extending upwardly from a paint well, and a cover that is removably coupled to the tray. The cover includes a raised portion that is disposed over the sloped portion of the tray when the cover is coupled to the tray. The cover defines a paint roller arm aperture that extends through the cover.

In another form, the present teachings provide a paint station with a worktable having a top surface with a roller tray recess and a pair of selectively extensible legs coupled to the worktable. Placement of the worktable in a work position with the legs in the extended position places the top surface at an elevation of at least 28 inches. Placement of the work table in a work position with the legs in the retracted position places the top surface at an elevation of between about 1 inch and about 8 inches In a further form, the present teachings provide a paint station with a worktable having a top surface with a roller tray recess, a pair of selectively extended legs, a cover and a fastening means to releasably couple the cover to the worktable.

In yet another form, the present teachings provide a paint station with a work table, which has a top surface with a roller tray recess, and first and second legs coupled to the work table that are movable between an extended position and a retracted position. The first set of legs is disposed between the worktable and the second set of legs when the first and second sets of legs are positioned in the retracted position. A handle aperture, which is formed in the second set of legs, facilitates transport of the paint station with the worktable in a position generally perpendicular to an orientation of the worktable when the paint station is positioned in a work position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE VARIOUS EMBODIMENTS

Figure 1:
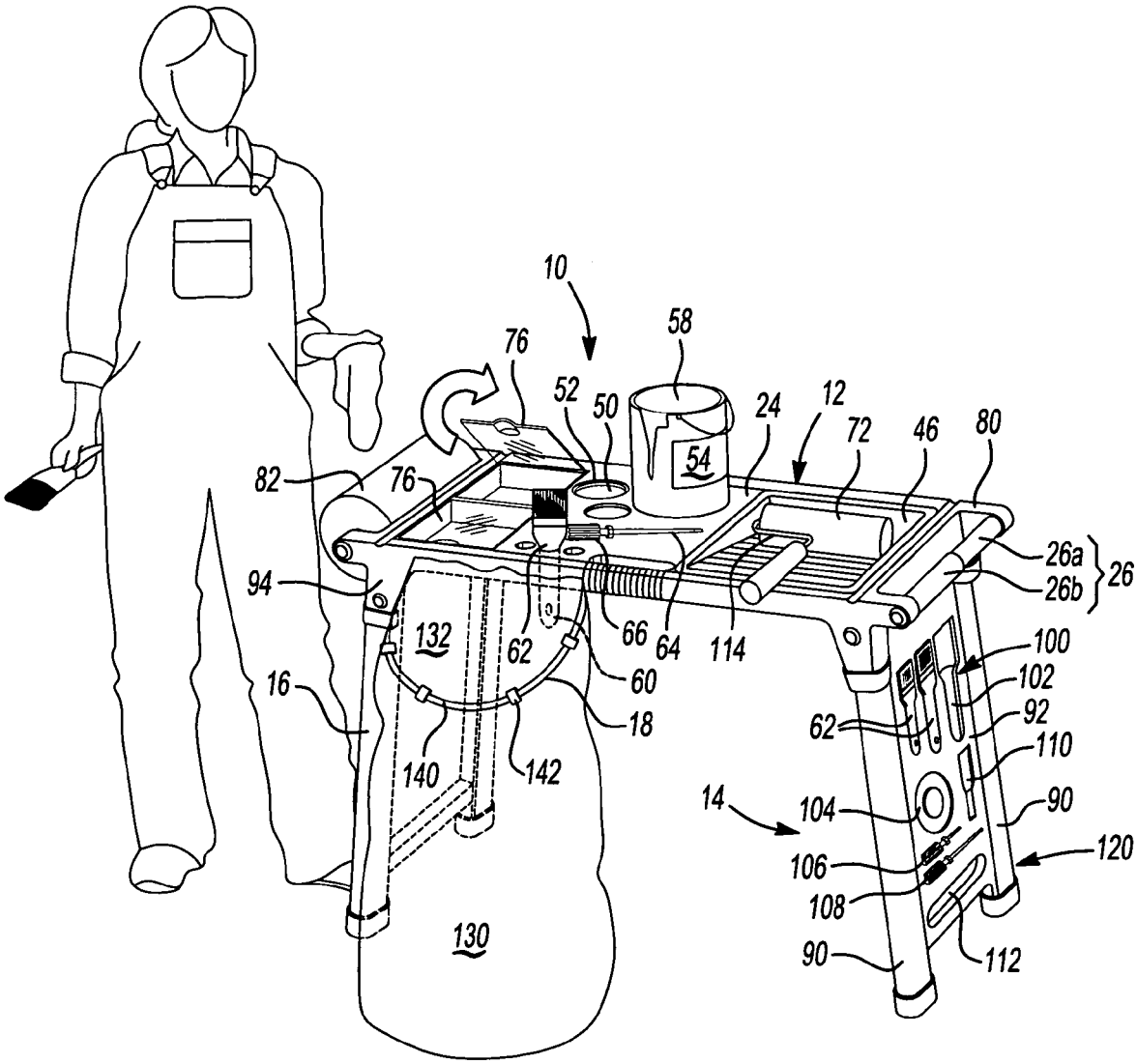
FIG. 1 is a perspective view illustrating a paint station constructed in accordance with the teachings of the present invention.
Figure 2:
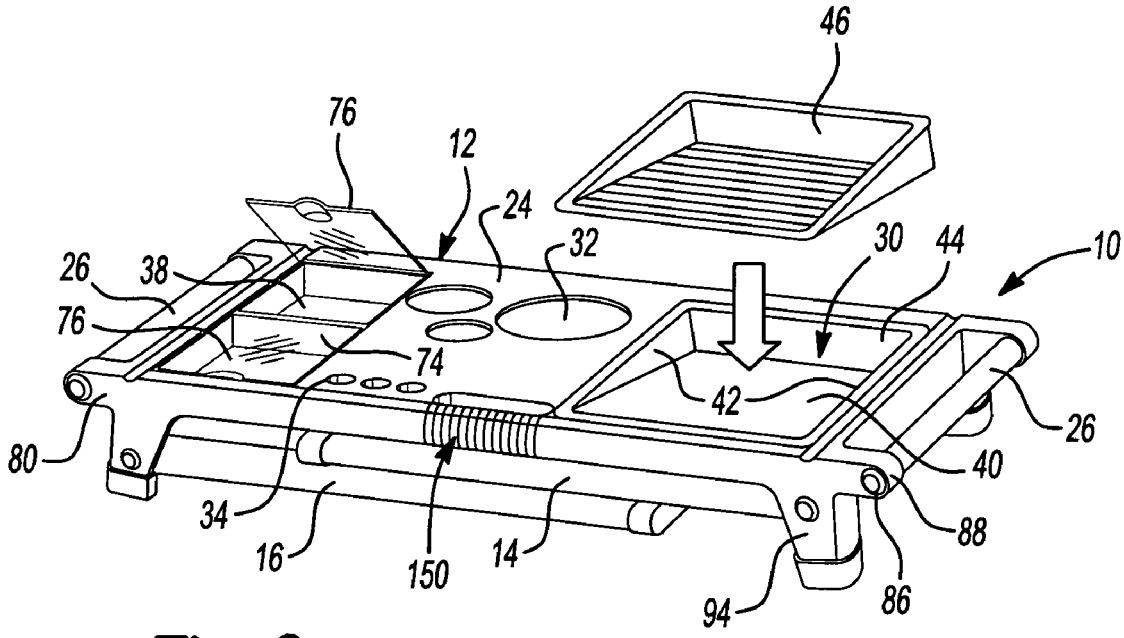
FIG. 2 is a perspective view of the paint station of FIG. 1 with the legs in a retracted condition.
Figure 3:
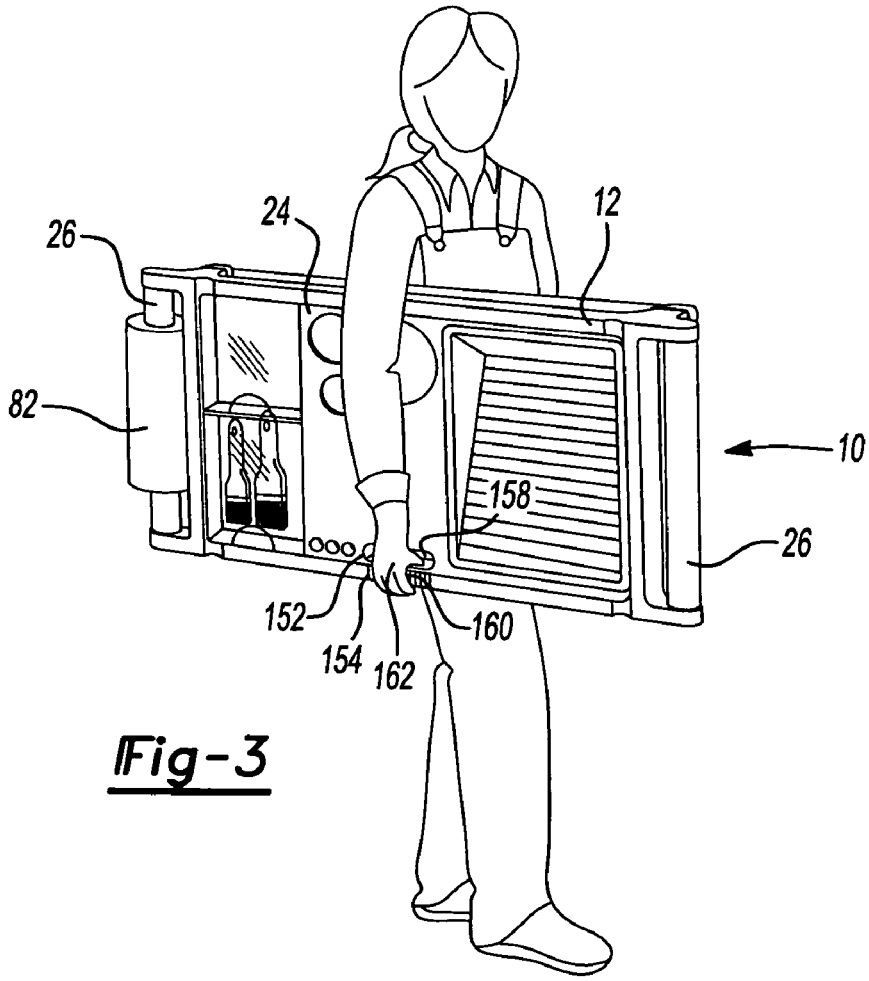
FIG. 3 is another perspective view of the paint station of FIG. 1.

With reference to FIGS. 1 through 3 of the drawings, a paint station constructed in accordance with the teachings of the present invention is generally indicated by reference numeral 10. The paint station 10 may include a worktable 12, a first set of legs 14, a second set of legs 16 and a disposable bag holder 18.

The work table 12 may include a table structure 24 and one or more handles 26. The table structure 24 may include a roller tray recess 30, one or more paint can recesses 32, one or more tool holder recesses 34 and a storage compartment 38. The roller tray recess 30 includes a sloped bottom wall 40, a pair of side walls 42 and an end wall 44 that are configured to support a conventional disposable tray liner 46 when the tray liner 46 is disposed in the roller tray recess 30. The paint can recesses 32 may include a can receiving portion 50 and a paint channel 52 that is disposed about the can receiving portion 50.

The can receiving portion 50 is sized to receive therein a can 54 of paint or stain of a predetermined size. The can receiving portions 50 may be sized differently and in the example provided, are sized to receive a gallon can, a quart can and a half-pint can. Alternatively, the can receiving portion 50 of one or more of the paint can recesses 32 may be configured to receive several differently sized cans (i.e., a gallon can, a quart can or a half-pint can) or to receive a plurality of smaller cans (e.g., a gallon can, a quart can and one or more half-pint cans, or several of half-pint cans). The paint channel 52 extends about the perimeter of the can receiving portion 50 and serves as a gutter into which paint 58 that drips down the side of a paint can 54 in the paint can receiving portion 50 may drain.

The tool holder recesses 34 may include a plurality of apertures that are formed through the table structure 24 to receive therethrough a portion of an associated tool, for example the handle 60 of a paint brush 62 or the blade 64 of a screwdriver 66.

The storage compartment 38 may be a discrete unit that is received into a corresponding recess that is formed into the table structure 24 or may be formed directly into the table structure 24 as is shown. The storage compartment 38 may be sized to receive articles including brushes 62 and rollers 72 that have been used in a painting operation. The storage compartment 38 may be provided with one or more dividers 74 that may be employed to organize the contents of the storage compartment 38. A lid 76 may be employed to selectively close the storage compartment 38. The lid 76 may be removably coupled to the table structure 24, or hingedly coupled to the table structure 24. The lid 76 may sealingly engage the structure that forms the storage compartment 38 (i.e., the table structure 24 in the example provided) so that brushes 62 that are wet with paint may be stored in the storage compartment 38 for a relatively short term without the paint drying.

The handles 26 may be supported on legs 80, which extend from the opposite sides of the table structure 24, such that the handles 26 are offset from the table structure 24. The handles 26 may be removably coupled to an associated pair of the legs 80 and may be employed to hold a roll of material 82, such paper toweling, tack cloth, or plastic sheeting. The handle 26 may include a first handle portion 26*a* that is telescopically received into a second handle portion 26*b*. Each of the first and second handle portions 26*a* and 26*b* may include a relatively small diameter stem 86 that is received into an aperture 88 that is formed in an associated one of the legs 80. The first and second handle portions 26*a* and 26*b* may be coupled in any suitable manner that permits the first handle portion 26*a* to be telescoped into and out of the second handle portion 26*b* so that handle 26 may be removed from and installed to the legs 80. For example, a spring (not shown) may be employed to bias the first handle portion 26*a* outwardly of the second handle portion 26*b* or the first and second handle portions 26*a* and 26*b* may be threadably engaged to one another.

The legs 14 and 16 may be coupled to the worktable 12 and may include a pair of leg members 90 and a brace 92 that is disposed between the leg member 90. The leg members 90 may be pivotally coupled to auxiliary legs 94 that are coupled to the table structure 24 and which support the table structure 24 when the legs 14 and 16 are in a folded position. The leg members 90 of the first set of legs 14 may be pivotally coupled to the auxiliary legs 94 at a point that is relatively higher than that of the second set of legs 16 to permit the first set of legs 14 to nest between the work table 12 and the second set of legs 16 when the legs 14 and 16 are in a folded condition. A detent (not shown) may be employed when the legs 14 and 16 are in the extended and folded conditions to further resist undesired folding or unfolding of the legs 14 and 16.

The brace 92 is a panel that is disposed between and fixedly coupled to a pair of the leg members 90 and may include a plurality of holding features 100 that permit the brace 92 to store various tools and supplies. In the example provided, the holding features 100 are recesses or wells 102 into which the tools and supplies may be received in a snap-fit manner. The tools and supplies may include, for example, brushes 62, masking tape 104, a slotted screwdriver 106, a Phillips screwdriver 108, a putty knife 110, a utility knife 112, a paint can opener (not shown), a paint stirring stick (not shown), and/or a roller frame 114. Those skilled in the art will appreciate that the paint station 10 may be marketed to potential purchasers with a set of tools 120 that may include some or all of the above-mentioned tools and supplies.

The holder 18 may be employed to hold a disposable trash bag 130 such that the opening 132 of the trash bag 130 is readily accessible to the user of the paint station 10. The holder 18 may include a frame 140 and a plurality of clip members 142 that are removably coupled to the frame 140 about its perimeter. The frame 140 may be formed of a wire or band of a self-supporting material (e.g., spring steel or plastic) and may be coupled to the work table 12 so as to be movable between a deployed condition, which is shown in FIG. 1, and an undeployed condition, which is shown in FIGS. 2 and 3. The frame 140 may be pivotally coupled to the work table 12 so as to fold between the underside of the table structure 24 and the first set of legs 14, or may be detachably coupled to the work table 12 and stored on one of the braces 92 (e.g., in one of the wells 102). To install a trash bag 130 to the holder 18 that is illustrated, a portion of the trash bag 130 may be inserted through the frame 140, the remainder of the trash bag 130 folded over the frame 140 and the clip members 142 installed to the frame 140.

To provide improved portability, the paint station 10 may further include a handle 150 that is formed into the work table 12 or one or both sets of legs 14 and 16. In the example provided, the handle 150 includes a recessed area 152, which is formed into the work table 12, and a grip 154 that is formed into a rim 156 that extends about the perimeter of the table structure 24. The recessed area 152 is configured to receive therein the user's thumb 158 so that the grip 154 is able to support the tehnar eminence 160 of the user's hand 162. Alternatively, the handle may be D-shaped and may be coupled to an edge of the worktable 12 or to one or both of the legs 14 and 16.

Figure 4:
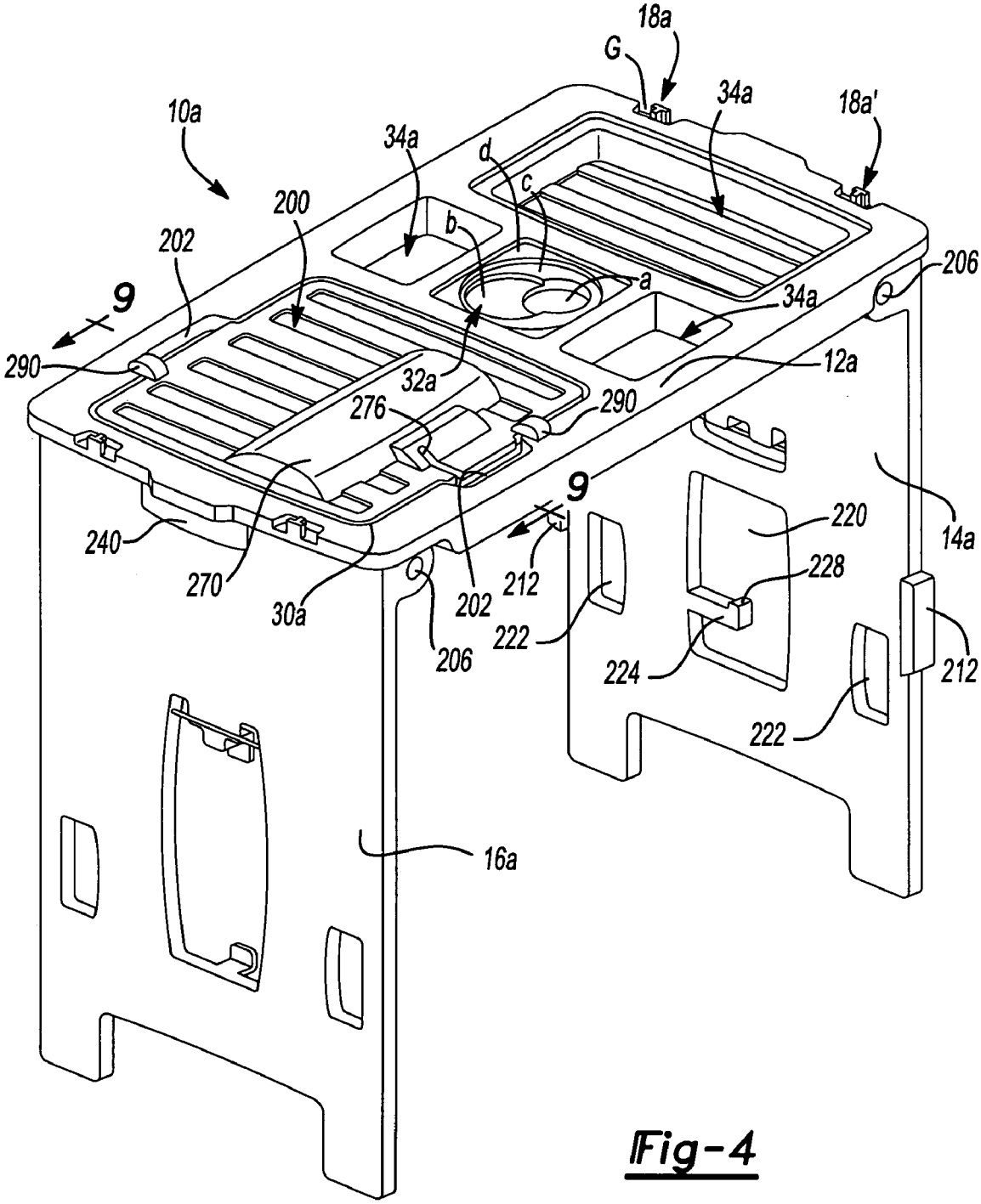
FIG. 4 is a perspective view of a second paint station constructed in accordance with the teachings of the present invention.
Figure 5:
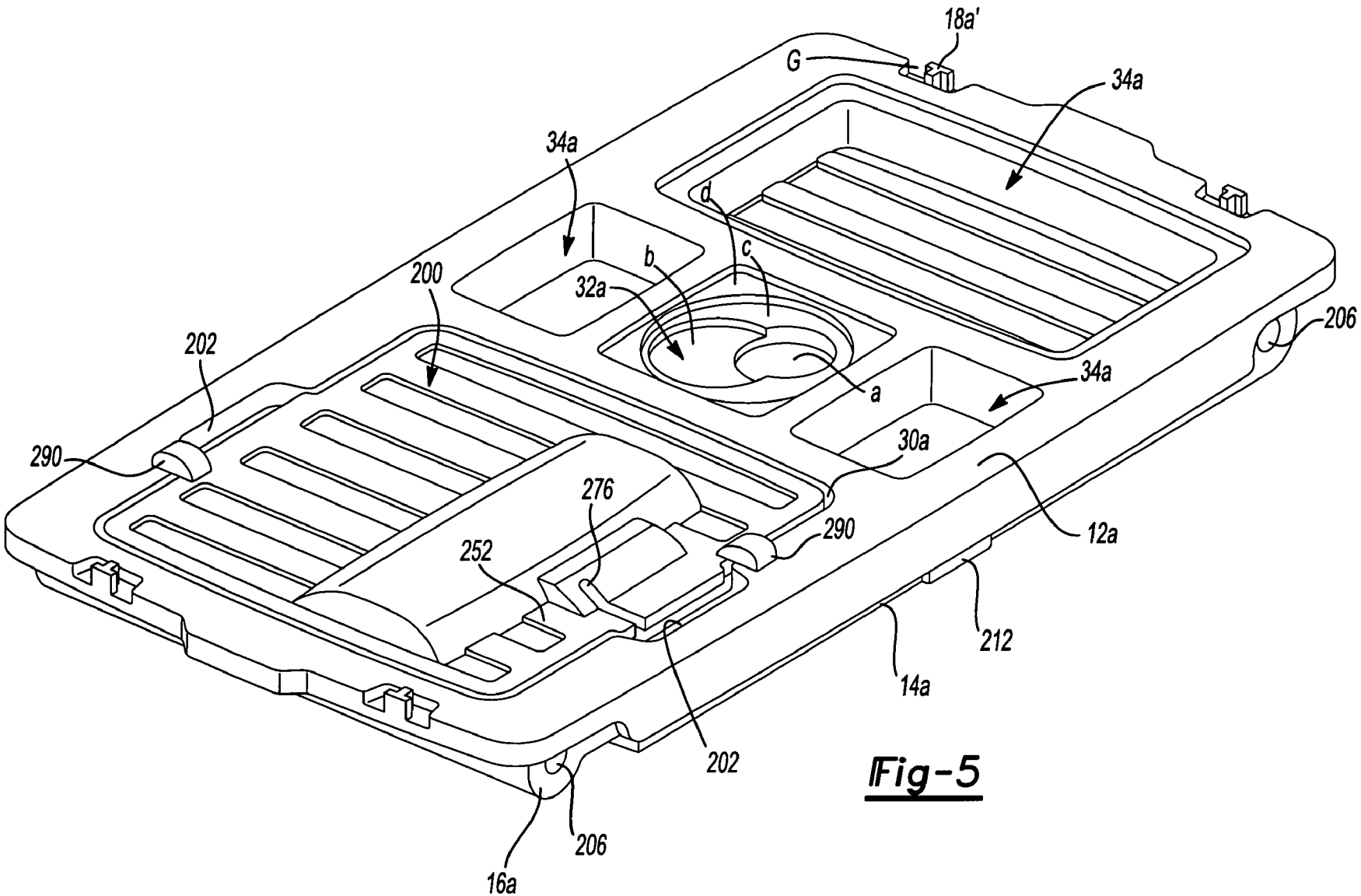
FIG. 5 is a perspective view of the paint station of FIG. 4 with the legs in a retracted position.
Figure 6:
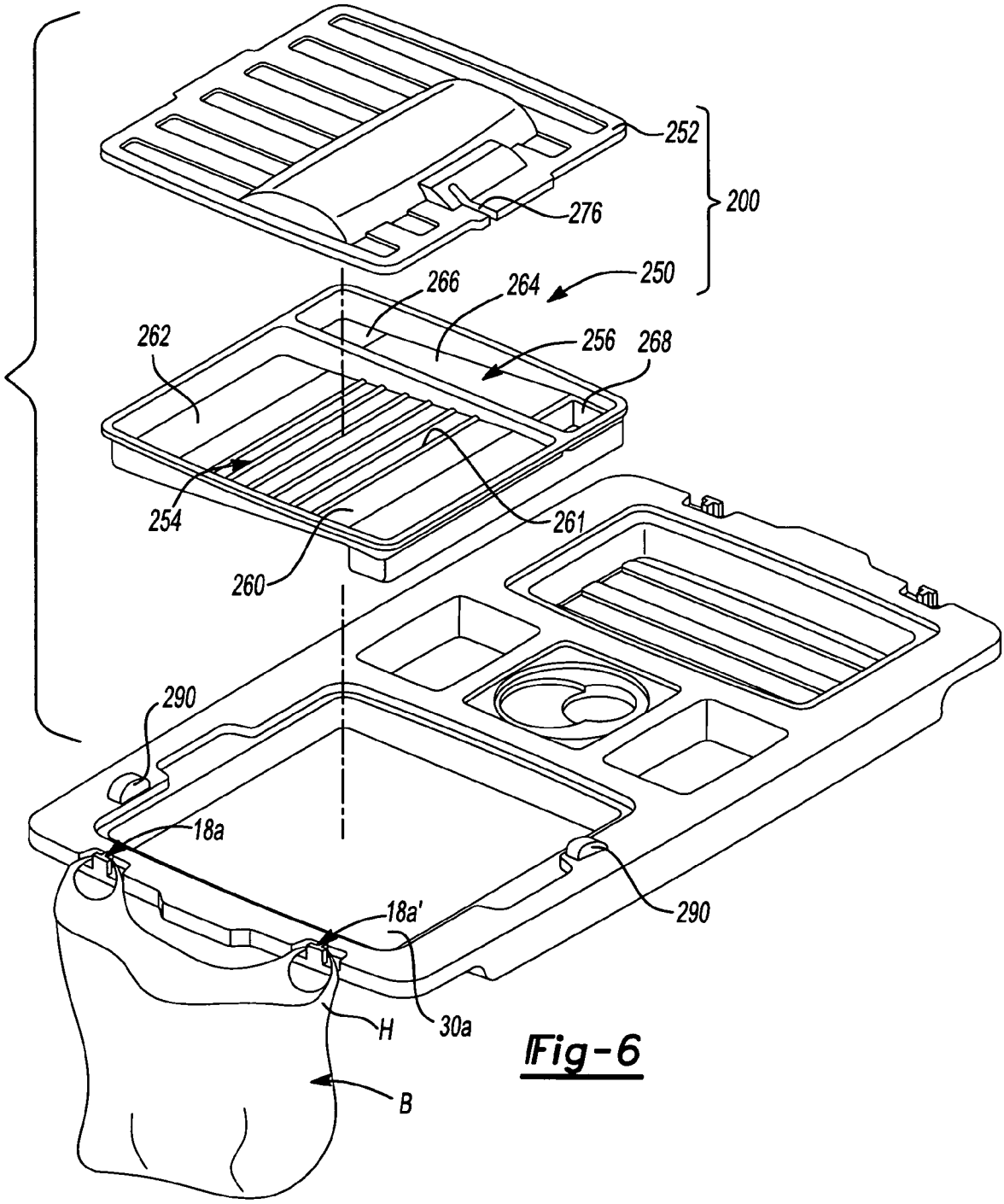
FIG. 6 is an exploded perspective view of a portion of the paint station of FIG. 4 illustrating the work table and tray assembly in greater detail.

With reference to FIGS. 4 through 6, a second paint station constructed in accordance with the teachings of the present invention is generally indicated by reference numeral 10*a*. The paint station 10*a* includes a worktable 12*a*, a first set of legs 14*a*, a second set of legs 16*a* and a tray assembly 200.

The worktable 12*a* may be formed of a material that is resistant to the adhesion of paint, such as polypropylene, and may include a roller tray recess 30*a*, a paint can recess 32*a* and one or more accessory recesses 34*a*. The roller tray recess 30*a* may be generally rectangular in shape and may be sized to receive the tray assembly 200 therein. In the example shown the roller tray recess 30*a* has a generally flat bottom, but other configurations, such as a partially sloped bottom such as that described above in conjunction with the paint station 10 of FIG. 1, may be employed. A pair of recesses 202 may be formed in the opposite sides of the roller tray recess 30*a* and may be sized to permit a user to reach under the tray assembly 200 and lift the tray assembly 200 out of the roller tray recess 30*a*. The paint can recess 32*a* may be configured in any desired manner but in the particular example provided, includes a plurality of recesses that include recess a, which is sized to receive a conventional pint can, recess b, which is sized to receive a conventional quart can, recess c, which is sized to receive a conventional round gallon can, and recess d, which is sized to receive a conventional square gallon can.

The accessory recesses 34*a* may be configured in any desired manner to hold tools (not shown), materials and/or work-site items (e.g., outlet and switch covers, hardware), for example. The accessory recesses 34*a* may be configured to receive therein disposable plastic containers, such as GLADWARE® containers that are marketed by The Clorox Company.

Optionally, the worktable 12*a* may include a disposable bag holder 18*a*, which may be constructed in any appropriate manner to releasably engage a disposable bag. In the example provided, the holder 18*a* includes a pair of clips 18*a'* that may be integrally formed with the worktable 12*a* and which may be configured to engage the handles H of a conventional polyethylene "t-shirt" bag B (i.e., plastic grocery bag). In the particular example provided, a groove G is disposed about a portion of the clip 18*a'* and is configured to receive therein a portion of the handle H of the bag B.

The first and second sets of legs 14*a* and 16*a* may be pivotally coupled to the worktable 12*a* and may be moved between an extended position, which is illustrated in FIG. 4, and a retracted position, which is illustrated in FIG. 5. With additional reference to FIG. 10, placement of the legs 14*a* and

16*a* into the retracted position permits the paint station 10*a* to be placed in a condition that is conducive for storage and transport.

Optionally, placement of the legs 14*a* and 16*a* into the retracted position permits the paint station 10*a* to be used at a different elevation (as compared to the elevation that is provided when the legs 14*a* and 16*a* are in the extended position), which may be appropriate when the paint station 10*a* is placed on another structure, such as a counter top, a table top or a desk top. For example, placement of the legs 14*a* and 16*a* into the extended position may place the work table 12*a* at an elevation of at least 28 inches when the work table 12*a* is in a work position (i.e., facing upwardly as shown in FIGS. 4 and 5), while placement of the legs 14*a* and 16*a* into the retracted position may place the work table 12*a* at an elevation of about 1 inch to about 8 inches when the work table 12*a* is in the work position. Any appropriate means may be employed to pivotally couple the legs 14*a* and 16*a* to the worktable 12*a* but in the example provided, an axle 206 supports each of the first and second sets of legs 14*a* and 16*a*.

Returning to FIGS. 4 and 10, any type of latch may optionally be coupled to the worktable 12*a* and the legs 14*a* and 16*a* to maintain the legs 14*a* and 16*a* in one or both of the extended and retracted positions. In the particular example provided, the leg 14*a* includes a pair of detent arms 212 that are configured to resiliently engage the opposite sides of the worktable 12*a* when the legs 14*a* and 16*a* are positioned in the retracted position. As the leg 16*a* is positioned between the worktable 12*a* and the leg 14*a*, engagement of the leg 14*a* to the worktable 12*a* prevents the leg 16*a* from freely pivoting from the retracted position to the extended position.

Figure 7:
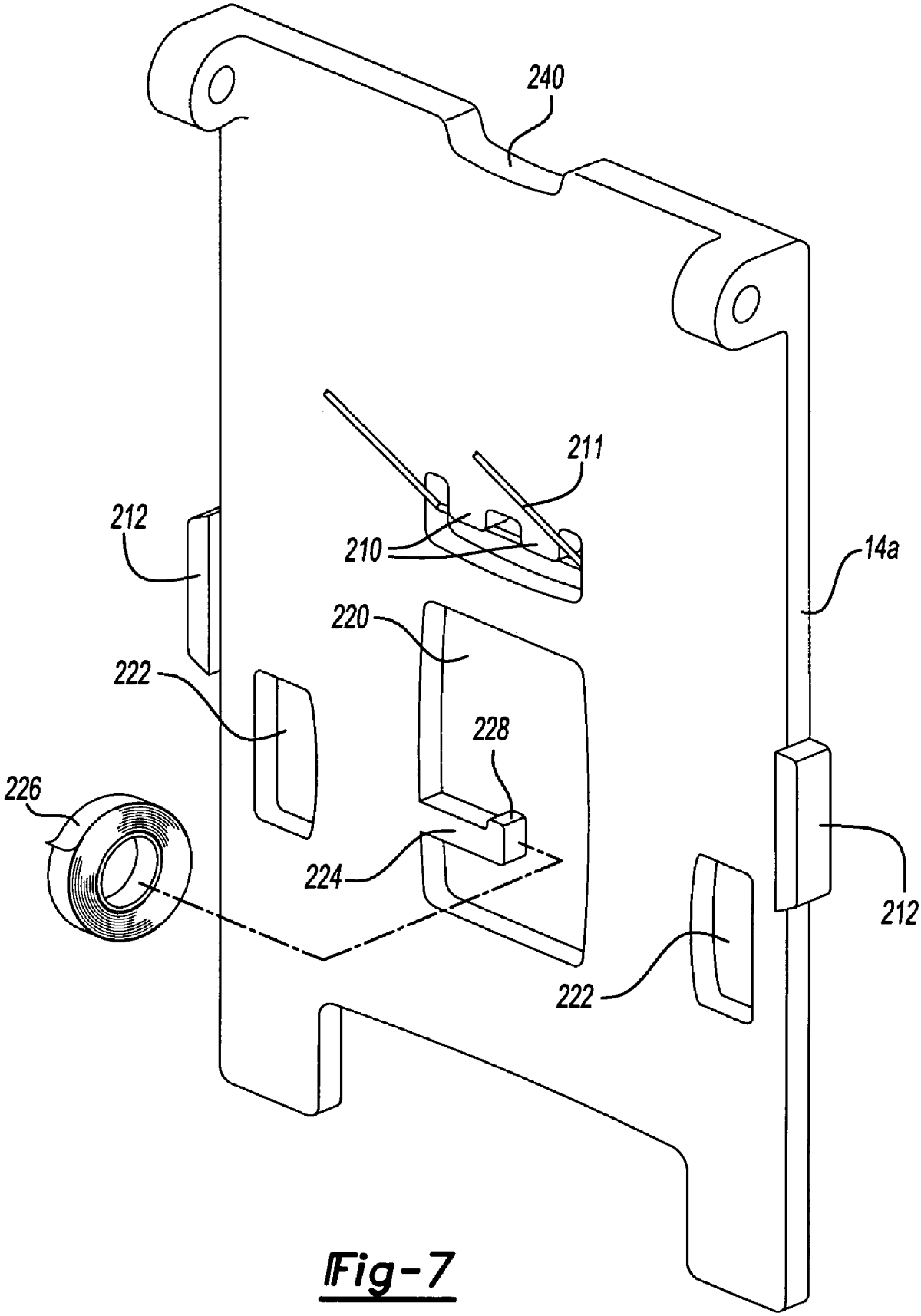
FIG. 7 is a perspective view of a portion of the paint station of FIG. 4 illustrating a first one of the legs in greater detail.

With additional reference to FIG. 7, the leg 14*a* may include a tool aperture 220 and one or more handle apertures 222. The tool aperture 220 may be configured to hold a tool or other supply or material. In the example provided, a projecting leg 224 extends into the tool aperture 220 to facilitate the storage of a roll of masking tape 226. The distal end 228 of the projecting leg 224 may be sized relatively larger than a remaining portion of the projecting leg 224 so as to prevent the roll of masking tape 226 from disengaging the projecting leg 224 in an unintended manner. The handle apertures 222 permit a user to hand-carry the paint station 10*a* with a single hand when the paint station 10*a* has been collapsed and tilted onto its side. In the example illustrated, the dual handle apertures 222 permit the paint station 10*a* to be hand carried regardless of the direction in which it has been flipped. Additionally, the dual handle apertures 222 permit the user to select between two positions hand carrying positions: a first position in which the user's hand is engaged to an upper one of the handle apertures 222, and a second position in which the user's hand is engaged to a lower one of the handle apertures 222. Use of an "upper" handle aperture 222 permits the user to carry the paint station 10*a* at a relatively low position (e.g., with the upper edge at about a waist-high level), whereas use of a "lower" handle aperture 222 permits the user to carry the paint station 10*a* at a relatively high position (e.g., with the upper edge at about the level of one's armpit).

Figure 8:
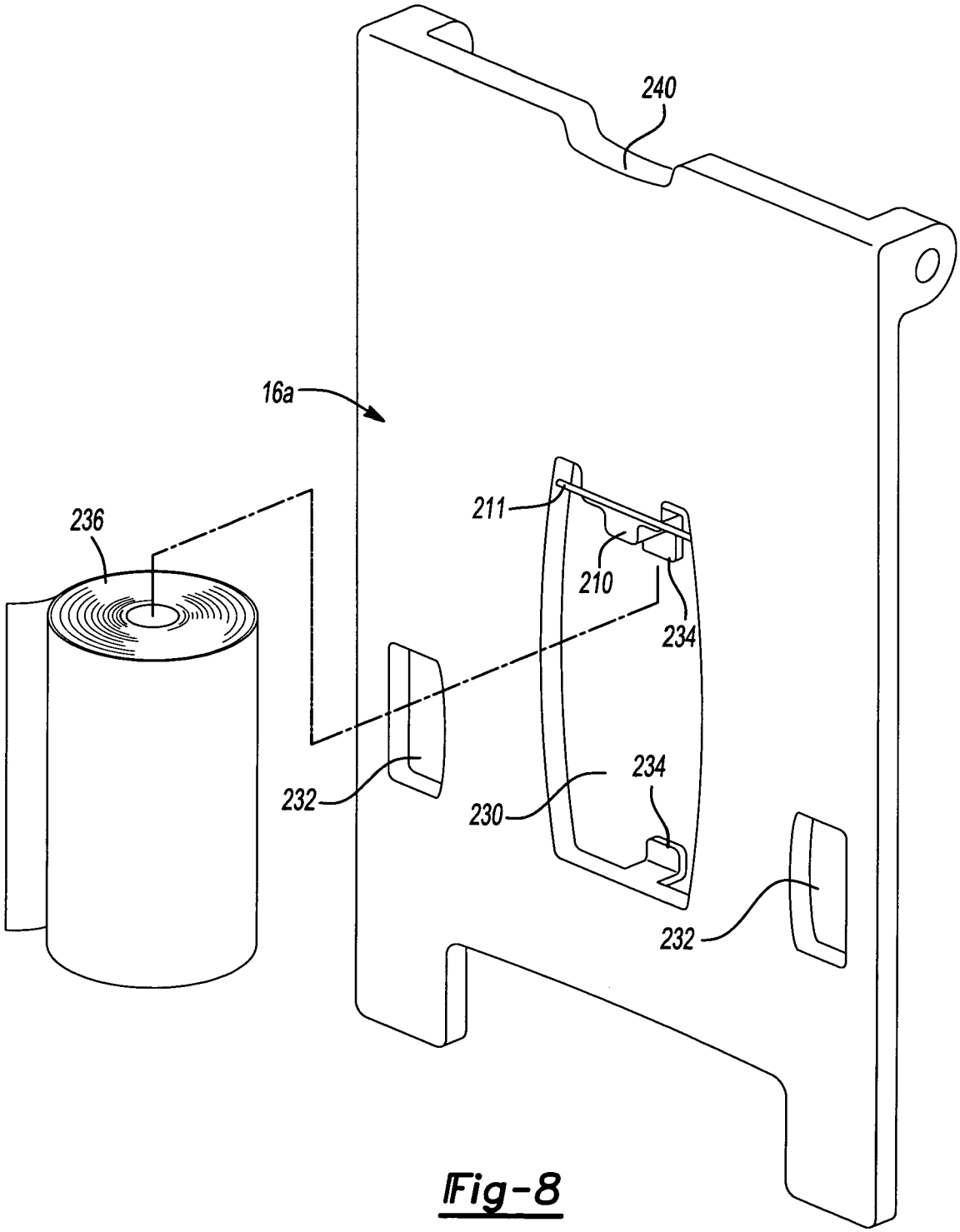
FIG. 8 is a perspective view of a portion of the paint station of FIG. 4 illustrating a second one of the legs in greater detail.
Figure 10:
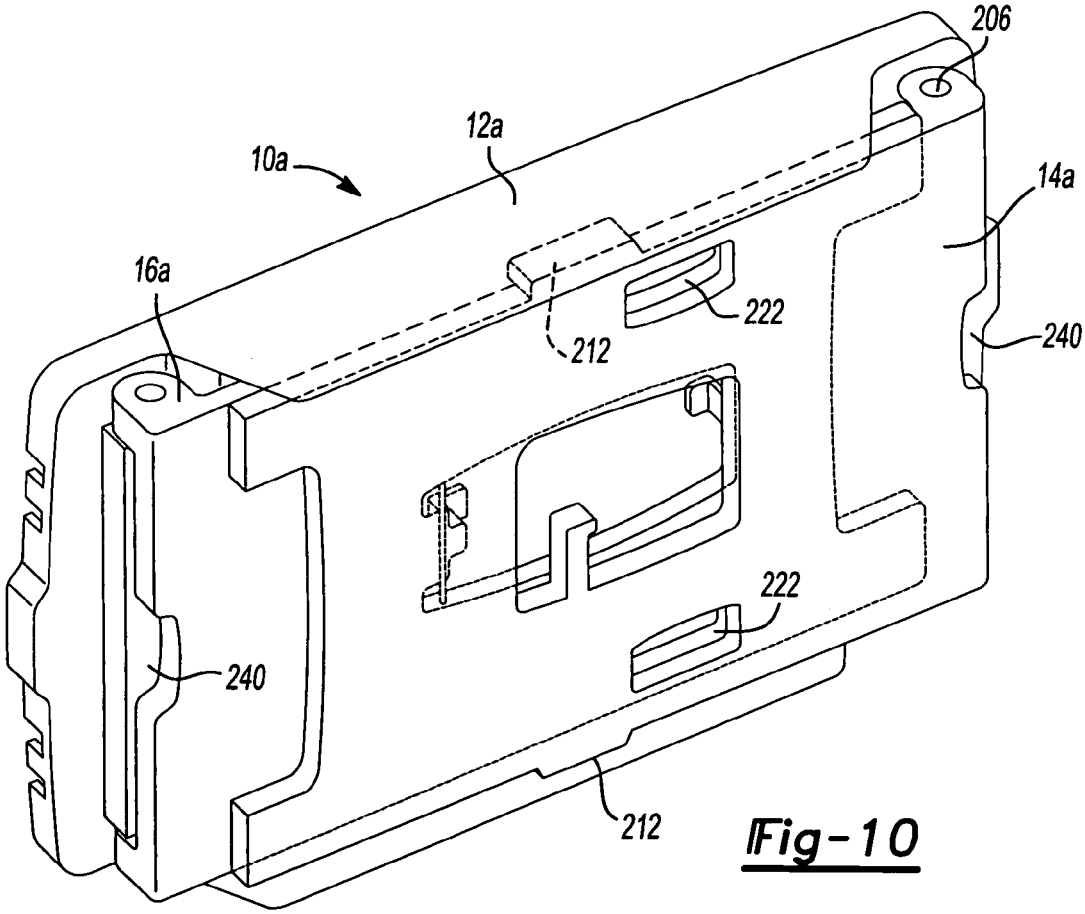
FIG. 10 is a view of the paint station of FIG. 4 in a transport condition.

With reference to FIGS. 4, 8 and 10, the leg 16*a* may also include a tool aperture 230 and one or more handle apertures 232. In the example provided, the tool aperture 230 includes a pair of tabs 234 that are configured to retain a roll of paper toweling 236 in the tool aperture 230. As the leg 16*a* is inboard of the leg 14*a* when the legs 14*a* and 16*a* are in the retracted position, the handle apertures 232 are positioned to align with the handle apertures 222 in the leg 14*a*.

Additionally, the legs 14*a* and 16*a* may include a recess 240 that is positioned proximate the worktable 12*a* that permits one or more users to grasp the opposite ends of the worktable 12*a* and lift the paint station 10*a* as shown in FIGS. 7 and 8.

Figure 9:
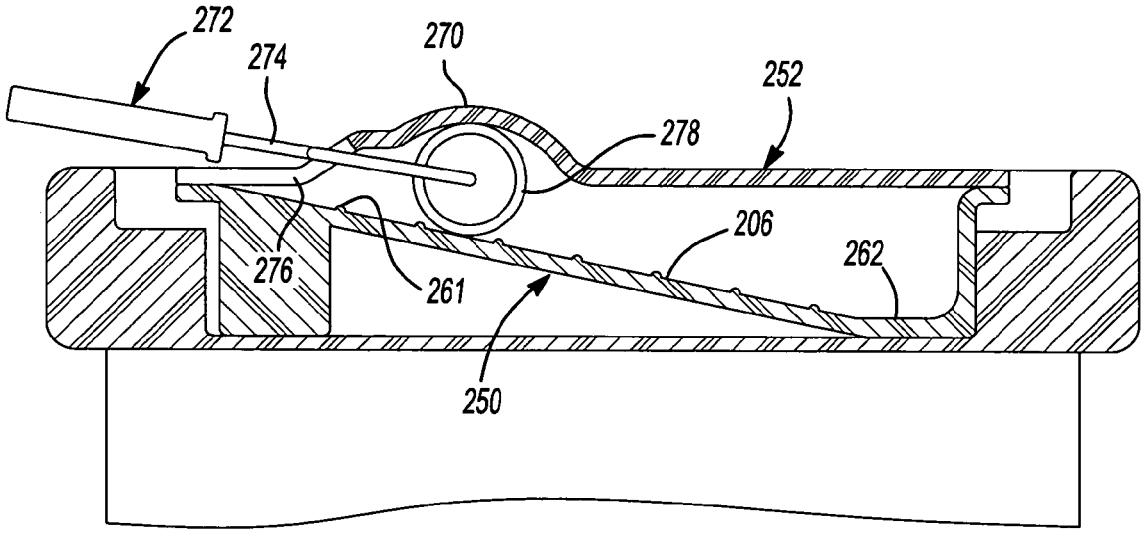
FIG. 9 is sectional view of a portion of the paint station of FIG. 4 illustrating the tray assembly in greater detail.

With reference to FIGS. 6 and 9, the tray assembly 200 may include a tray 250 and a cover 252. The tray 250 and/or the cover 252 may be formed of any suitable material, such as a material that is resistant to adhesion of a latex-based and/or acrylic-based paint. One such material is polypropylene. The tray 250 may include first portion 254, which is configured for use with roller-type paint applicators, and a second portion 256, which is configured for use with brush-type paint applicators. The first portion 254 may have a first sloped portion 260 and a first well (i.e., a first paint well) 262 that is positioned at a lower end of the first sloped portion 260. The first sloped portion 260 may have a textured surface that may include ribs 261 or other features that aid the user to work paint into a roller applicator. Similarly, the second portion 256 may have a second sloped portion 264 and a second well 266 that is positioned at a lower end of the second sloped portion 264. An optional storage well 268, which may be configured to hold an applicator such as a brush, may be formed into the second portion 256 on a side of the second sloped portion 264 opposite the second well 266. The first and second wells 262 and 266 are configured to hold a quantity of paint for use with an appropriate applicator, while the first and second sloped portions 260 and 264 provide an area where paint may be worked into a particular applicator. The sloped character of the first and second sloped portions 260 and 264 permits paint on a surface thereof to drain back into the first and second wells 262 and 266, respectively.

The cover 252 is configured to overlie the tray 250. Optionally, the cover 252 may engage the tray 250 in a snap-lock manner. The cover 252 is generally flat, with the exception of a raised portion 270 that is located directly over the first sloped portion 260 when the cover 252 overlies the tray 250. When the cover 252 overlies the tray 250, the raised portion 270 may be spaced apart from the first sloped portion by a distance that permits the roller 278 of the roller applicator 272 to reside therein at a location that does not position the roller 278 in the first well 262. With a roller applicator 272 positioned between the first sloped portion 260 and the raised portion 270, the arm 274 of the roller applicator 272 extends outwardly of the tray assembly 200 through a roller arm aperture, such as a slot or notch 276 in the cover 252. Configuration in this manner permits the roller 278 of the roller applicator 272 to be positioned on the first sloped portion 260 for short-term storage (e.g., overnight). We have found that the connection between the tray 250 and the cover 252 need not be "air tight" to prevent the skinning-over of the paint in the first and second wells 262 and 266, but rather skinning-over of the paint is prevented so long as the tray 250 is substantially covered and air cannot readily flow over the paint in the tray 250.

The paint station 10*a* may include some means, such as a snap-fit connection, fasteners, clamps, Velcro®, etc. to retain the tray assembly 200 in the roller tray recess 30*a*. With additional reference to FIG. 4, two C-shaped clamp members 290 are rotatably coupled to the work table 12*a* in the particular example provided and may be rotated between a first position (FIG. 4), in which they overlie the cover 252, and a second position (FIG. 6) in which they clear the roller tray recess 30*a* to permit the tray assembly 200 to be installed to or withdrawn from the roller tray recess 30*a*. In the example provided, the clamp members 290 apply a modest but sufficient degree of force onto the cover 252 to force the cover 252 into abutment with the tray 250. The camp members 290 may be employed to close the cover 252 against the tray 250 during a break in a painting session (e.g., to prevent debris and foreign objects from dropping into the tray 250 and/or to resist the skimming-over of paint in the tray 250) or when the tray 250 is empty of paint and the paint station 10*a* is to be transported or stored. As those of ordinary skill in the art will appreciate from this disclosure, the tray assembly 200 may be used to store various tools and supplies, including brushes, rollers, roller applicators, masking tape, screwdrivers, spackle knives, etc.

Although the paint station 10*a* has been described as employing a tray assembly with a cover, it will be appreciated from this disclosure that the cover 252 may be configured for use directly with the work table (e.g., a work table having a roller tray recess 30 of the type illustrated in FIG. 1). Accordingly, the cover 252 may directly engage the worktable 12*a* or may engage a structure that is intermediate the cover 250 and the worktable 12*a* (e.g., the tray 250).

While the worktable 12*a* has been illustrated and described as having a roller tray recess 30*a* with a substantially flat surface (which permits the tray assembly 200 to be selectively positioned facing either side of the worktable 12*a*), those of ordinary skill in the art should appreciate that the roller tray recess 30*a* may be configured somewhat differently. For example, the roller tray recess 30*a* may be configured with a sloped lower surface that is configured to support a commercially available disposable tray liner. Moreover, it will be appreciated that the roller tray recess 30*a* (and the tray assembly 200, if provided) may be sized or shaped differently from that which is illustrated in the attached drawings. For example, the roller tray recess 30*a* and the tray assembly 200 may be generally square in shape, thereby permitting the tray assembly 200 to be selectively oriented to either side or end of the worktable 12*a* as desired.

While the invention has been described in the specification and illustrated in the drawings with reference to various embodiments, it will be understood by those skilled in the art that various changes may be made and equivalents may be substituted for elements thereof without departing from the scope of the invention as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise, above. Moreover, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the foregoing description and the appended claims.

What is claimed is:

1. A paint station comprising:

a work table having a top surface with a roller tray recess;

a set of first legs coupled to the work table and movable between an extended position and a retracted position;

a set of second legs fixedly coupled to the work table;

a disposable bag holder coupled to one of the worktable and the legs;

a tray received in the roller tray recess, the tray having a sloped portion extending upwardly from a paint well; and a cover that is removably coupled to the tray, the cover including a raised portion that is disposed over the sloped portion of the tray when the cover is coupled to the tray, the cover defining a paint roller arm aperture that extends through the cover, wherein the raised portion is adapted to receive a paint roller of a predetermined diameter when the cover is coupled to the tray, an end of the raised portion closest to the paint well being spaced apart from the sloped portion of the tray by a distance that is smaller than the predetermined diameter to thereby prevent the paint roller from traveling down the sloped portion of the tray and into the paint well when the paint roller is disposed in the cover and the cover is coupled to the tray;

wherein the set of first legs are longer than the set of second legs, wherein positioning of the set of first legs in the extended position is configured to position the top surface of the work table at a first elevation and wherein positioning of the set of first legs in the retracted position so that the set of second legs support the work table is configured to position the top surface of the work table at a second elevation that is smaller than the first elevation; and wherein the disposable bag holder includes a pair of clips, each of the clips being configured to engage a handle of a polyethylene "t-shirt" bag.

2. The paint station of claim 1, wherein the paint roller arm aperture is a slot.

3. The paint station of claim 2, further comprising a roller applicator having a handle, a roller and an arm coupled to the handle and rotatably supporting the roller, the roller applicator being positionable such that the roller is disposed between the sloped portion of the tray and the raised portion of the cover and the roller arm extends through the cover.

4. The paint station of claim 1, wherein at least one of the tray and the cover is formed from a material that is resistant to adhesion of a paint having a latex base and an acrylic base.

5. The paint station of claim 1, wherein the sloped portion includes a textured surface.

6. The paint station of claim 5, wherein the textured surface includes a plurality of ribs.

7. The paint station of claim 1, wherein the cover resiliently engages the tray in a snap-lock manner.

8. The paint station of claim 1, wherein the legs are pivotally coupled to opposite sides of the worktable.

9. The paint station of claim 1, wherein the roller tray recess includes a generally flat bottom.

10. The paint station of claim 1, wherein a portion of the roller tray recess is sloped.

11. The paint station of claim 1, wherein the top surface includes at least one paint can recess.

12. The paint station of claim 11, wherein the at least one paint can recess includes a plurality of at least partially overlapping circular recesses.

13. The paint station of claim 11, wherein the at least one paint can recess includes a generally square recess.

14. A paint station comprising:

a work table having a top surface with a roller tray recess;

a set of first legs coupled to the work table and movable between an extended position and a retracted position; and a set of second legs fixedly coupled to the work table;

wherein the set of first legs are longer than the set of second legs, wherein positioning of the set of first legs in the extended position is configured to position the top surface of the work table at a first elevation and wherein positioning of the set of first legs in the retracted position so that the set of second legs support the work table is configured to position the top surface of the work table at a second elevation that is smaller than the first elevation;

wherein the top surface includes at least one paint can recess; and wherein the at least one paint can recess includes a generally square recess, a first circular recess having the same origin as the generally square recess, a second circular recess entirely contained within the first circular recess, and a third circular recess entirely contained within the first circular recess and at least partially overlapping the second circular recess.

* * * * *